US011008692B2

(12) United States Patent
Leitert et al.

(10) Patent No.: US 11,008,692 B2
(45) **Date of Patent: *May 18, 2021**

(54) METHOD OF DETERMINING A LOAD SIZE IN A LAUNDRY TREATING APPLIANCE

(71) Applicant: WHIRLPOOL CORPORATION, Benton Harbor, MI (US)

(72) Inventors: Andrew Leitert, Eau Claire, MI (US); Karl David McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 276 days.

This patent is subject to a terminal disclaimer.

(21) Appl. No.: 16/162,970

(22) Filed: Oct. 17, 2018

(65) Prior Publication Data

US 2019/0048504 A1 Feb. 14, 2019

Related U.S. Application Data

(60) Division of application No. 15/171,146, filed on Jun. 2, 2016, now Pat. No. 10,156,037, which is a (Continued)

(51) Int. Cl.
*D06F 34/18* (2020.01)
*D06F 33/00* (2020.01)

(Continued)

(52) U.S. Cl.
CPC ..... *D06F 34/18* (2020.02); *D06F 33/00* (2013.01); *D06F 34/28* (2020.02); *D06F 35/006* (2013.01);

(Continued)

(58) Field of Classification Search
CPC .. D06F 34/18; D06F 2101/04; D06F 2103/04; G06K 9/00
See application file for complete search history.

(56) References Cited

U.S. PATENT DOCUMENTS 5,515,565 A * 5/1996 Maddix ..... D06F 34/18 8/158
6,842,532 B2 1/2005 Hu et al.

(Continued)

FOREIGN PATENT DOCUMENTS

DE 3804624 A1 8/1989
EP 0544945 A1 6/1993

(Continued)

OTHER PUBLICATIONS

European Search Report for Corresponding EP14169495.0, dated Oct. 13, 2014.

(Continued)

*Primary Examiner* — Joseph L. Perrin
*Assistant Examiner* — Kevin G Lee
(74) *Attorney, Agent, or Firm* — McGarry Bair PC

(57) ABSTRACT

Method of determining a laundry load size in a laundry treating appliance comprising a rotatable drum at least partially defining a treating chamber for receiving laundry for treatment in accordance with a treating cycle of operation, an imaging device, and a controller having a processor, the method includes generating an image, detecting markings in the generated image, and determining, by the controller, a load size based thereon.

20 Claims, 5 Drawing Sheets

Related U.S. Application Data continuation of application No. 13/908,011, filed on Jun. 3, 2013, now Pat. No. 9,382,654.

(51) Int. Cl.

| | |
|---|---|
| *D06F 34/28* | (2020.01) |
| *D06F 103/02* | (2020.01) |
| *D06F 103/04* | (2020.01) |
| *D06F 101/04* | (2020.01) |
| *D06F 35/00* | (2006.01) |

(52) U.S. Cl.

CPC ..... *D06F 2101/04* (2020.02); *D06F 2103/02* (2020.02); *D06F 2103/04* (2020.02); *D06F 2202/10* (2013.01); *D06F 2202/12* (2013.01)

(56) References Cited

U.S. PATENT DOCUMENTS

| | | | |
|---|---|---|---|
| 7,380,423 | B1 | 6/2008 | Musone |
| 7,601,978 | B2 | 10/2009 | Sari-Sarraf et al. |
| 8,229,204 | B2 | 7/2012 | Wagner |
| 2001/0049846 | A1 | 12/2001 | Guzzi et al. |
| 2009/0107234 | A1 | 4/2009 | Kim et al. |
| 2010/0205819 | A1 | 8/2010 | Ashrafzadeh et al. |
| 2010/0205820 | A1 | 8/2010 | Ashrafzadeh et al. |
| 2010/0205823 | A1 | 8/2010 | Ashrafzadeh et al. |
| 2010/0205825 | A1 | 8/2010 | Ashrafzadeh et al. |
| 2010/0205826 | A1 | 8/2010 | Ashrafzadeh et al. |
| 2012/0110749 | A1 | 5/2012 | Park et al. |
| 2012/0138092 | A1 | 6/2012 | Ashrafzadeh et al. |

FOREIGN PATENT DOCUMENTS

| | | | |
|---|---|---|---|
| EP | 2559800 | A2 | 2/2013 |
| FR | 2894996 | A1 | 6/2007 |
| GB | 2458927 | A | 10/2009 |
| JP | 4244193 | A | 9/1992 |
| JP | H04244193 | A | 9/1992 |
| JP | 2991511 | B2 | 12/1999 |
| JP | 2002224486 | A | 8/2002 |
| NZ | 535898 | A | 10/2006 |

OTHER PUBLICATIONS

European Search Report for Corresponding EP14169498.4, dated Oct. 15, 2014.

* cited by examiner

METHOD OF DETERMINING A LOAD SIZE IN A LAUNDRY TREATING APPLIANCE

CROSS-REFERENCE TO RELATED APPLICATIONS

This application is a division of U.S. patent application Ser. No. 15/171,146 filed on Jun. 2, 2016, now U.S. Pat. No. 10,156,037, issued on Dec. 18, 2018, which is a continuation of U.S. patent application Ser. No. 13/908,011 filed on Jun. 3, 2013, now U.S. Pat. No. 9,382,654, issued on Jul. 5, 2016, all of which are hereby incorporated by reference in their entirety.

BACKGROUND

Laundry treating appliances, such as clothes washers, clothes dryers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The cycles of operation may vary according to the size of the laundry load in the drum. The size of the laundry load may be manually input by the user through a user interface. Oftentimes a user will overestimate or underestimate the load size, thereby resulting in a less than optimal treating performance. Furthermore, laundry treating appliances currently measure mass but this may not provide a full understanding of the load size and may cause confusion for the user when mass is indicated.

BRIEF SUMMARY

In one aspect the present disclosure relates to a method of determining a laundry load size in a laundry treating appliance comprising an imaging device and a controller having a processor, the method comprising generating an image, with the imaging device, of at least a portion of the treating chamber where the treating chamber has detectable graduated markings, detecting, by the controller, at least one of the detectable graduated markings in the generated image and determining, by the controller, a load size based on the detected at least one of the detectable graduated marking wherein the determining the load size comprises comparing the detected at least one of the detectable graduated marking to reference information that indicates a free volume or free height associated with the detected at least one of the detectable graduated marking.

DETAILED DESCRIPTION

Figure 1:
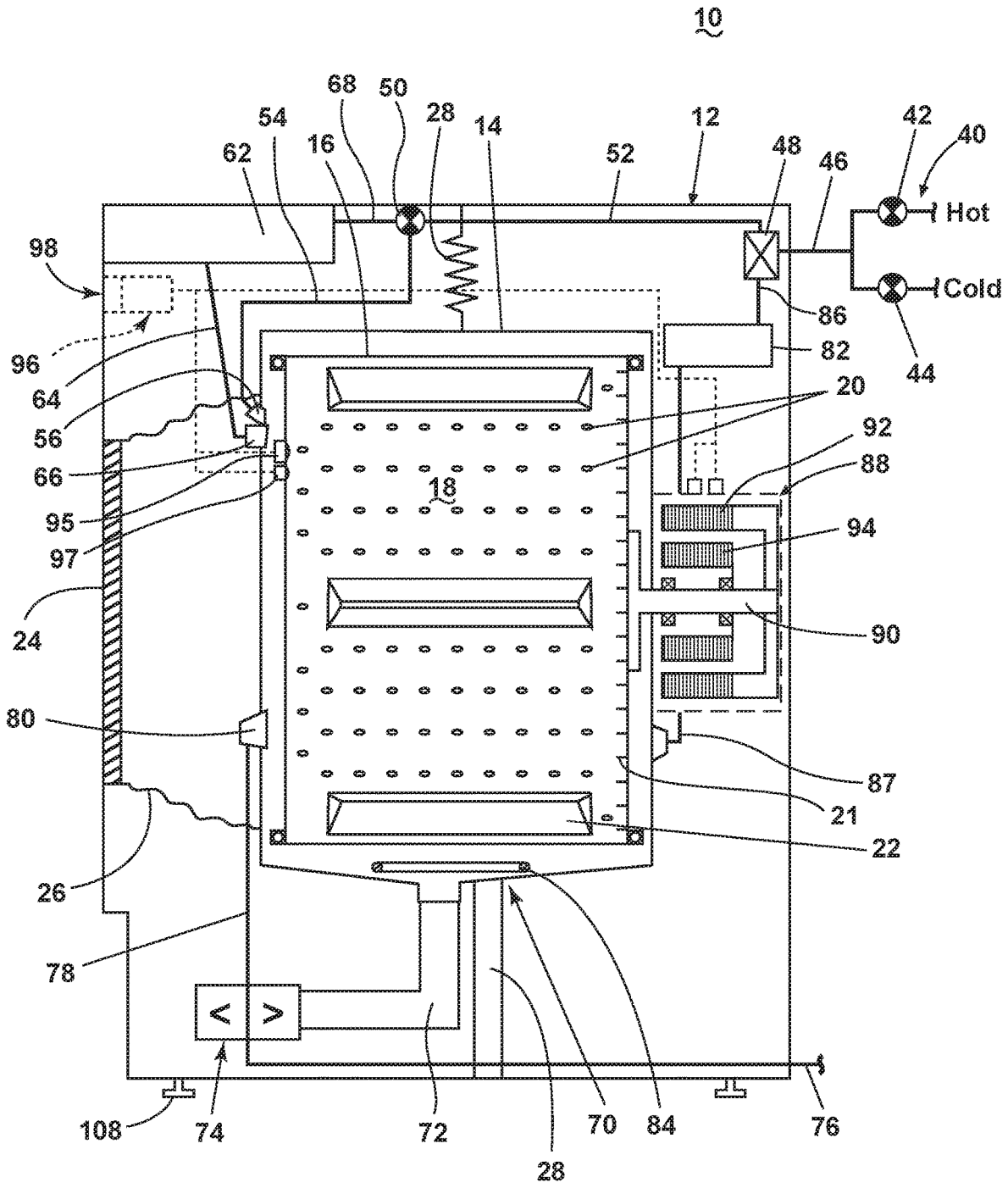
FIG. 1 is a schematic view of a laundry treating appliance in the form of a washing machine.

FIG. 1 is a schematic view of a laundry treating appliance that may implement an embodiment of a method of the invention. The laundry treating appliance may be any appliance which performs a cycle of operation to clean or otherwise treat items placed therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a drum 16 provided within the tub 14, the drum 16 defining at least a portion of a laundry treating chamber 18 for receiving a laundry load for treatment. The drum 16 may include a plurality of perforations 20 such that liquid may flow between the tub 14 and the drum 16 through the perforations 20. Graduated markings 21 may be included on a portion of the laundry treating chamber 18 including on the drum 16, a rear bulkhead, a front bulkhead, a door/window, or a combination of the above. Multiple graduated markings 21 may be included on the laundry treating chamber 18 and any suitable type of graduated marking 21 may be included. The graduated markings may be formed in any suitable manner including that the graduated markings 21 may have a reflectance or a specific color to allow them to stand out better from the laundry treating chamber 18 and any laundry located therein. The graduated markings may be any suitable shape including lines, curves, etc. It is also contemplated that the plurality of perforations 20 may also form the graduated markings 21.

A plurality of baffles 22 may be disposed on an inner surface of the drum 16 to lift the laundry load received in the treating chamber 18 while the drum 16 rotates. It may also be within the scope of the invention for the laundry holding system to include only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled with the rotating drum 16 and configured to compensate for a dynamic imbalance during rotation of the rotatable drum 16. The balancing material may be in the form of balls, fluid, or a combination thereof. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled with opposite ends of the rotatable drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through the tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

An imaging device 95 may be configured to image the treating chamber 18 and/or anything within the treating chamber 18. Exemplary imaging devices 95 may include any optical sensor capable of capturing still or moving images, such as a camera. One suitable type of camera may be a CMOS camera. Other exemplary imaging devices include a CCD camera, a digital camera, a video camera or any other type of device capable of capturing an image. That camera may capture either or both visible and non-visible radiation. For example, the camera may capture an image using visible light. In another example, the camera may capture an image using non-visible light, such as ultraviolet light. In yet another example, the camera may be a thermal imaging device capable of detecting radiation in the infrared region of the electromagnetic spectrum. The imaging device 95 may be located on either of the rear or front bulkhead, in the door 24, or on the drum 16. It may be readily understood that the location of the imaging device 95 may be in numerous other locations depending on the particular structure of the washing machine 10 and the desired position for obtaining an image. The location of the imaging device may depend on the type of desired image, the area of interest within the treating chamber 18, or whether the image may be captured with the drum in motion. For example, if the drum 16 is to be stopped during imaging and the laundry load is of interest, the imaging device 95 may be positioned so that its field of view includes the bottom and back of the drum 16. The imaging device may also be placed such that the entire or substantially the entire treating chamber 18 is within the field of view of the imaging device 95. There may also be multiple imaging devices, which may imaging the same or different areas of the treating chamber 18.

An illumination source 97 may also be included to illuminate a portion of the laundry treating chamber 18. The type of illumination source 97 may vary. In one configuration, the illumination source 97 may be an incandescent light, one or more LED lights, etc. The illumination source 97 may also be located in any suitable location. While only a single illumination source 97 has been illustrated any number of illumination sources may be included including that an array of LED lights may be placed at multiple positions on a front bulkhead.

The illumination source 97 may be located on the same side of the drum 16 as the imaging device 95, as illustrated, or may be located on a different side of the drum 16. When the illumination source 97 may be located on the same side of the drum 16 as the imaging device 95, the imaging device 95 may detect the light that may be reflected by the drum 16, the laundry load, and the graduated markings 21. Image analysis may then be used to isolate the drum 16, the laundry load, and the graduated markings 21. At any instant in time, a given location in an image will be dark or light depending on whether or not laundry is present at that location.

The illumination generated by the illumination source may vary, and may well be dependent on the type of imaging device. For example, the illumination may be infrared if the imaging device may be configured to image the infrared spectrum. Similarly, the illumination may be visible light, if the imaging device may be configured to image the visible spectrum.

The washing machine 10 also includes a control system for controlling the operation of the washing machine 10 to implement one or more cycles of operation. The control system may include a controller 96 located within the cabinet 12 and a user interface 98 that may be operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
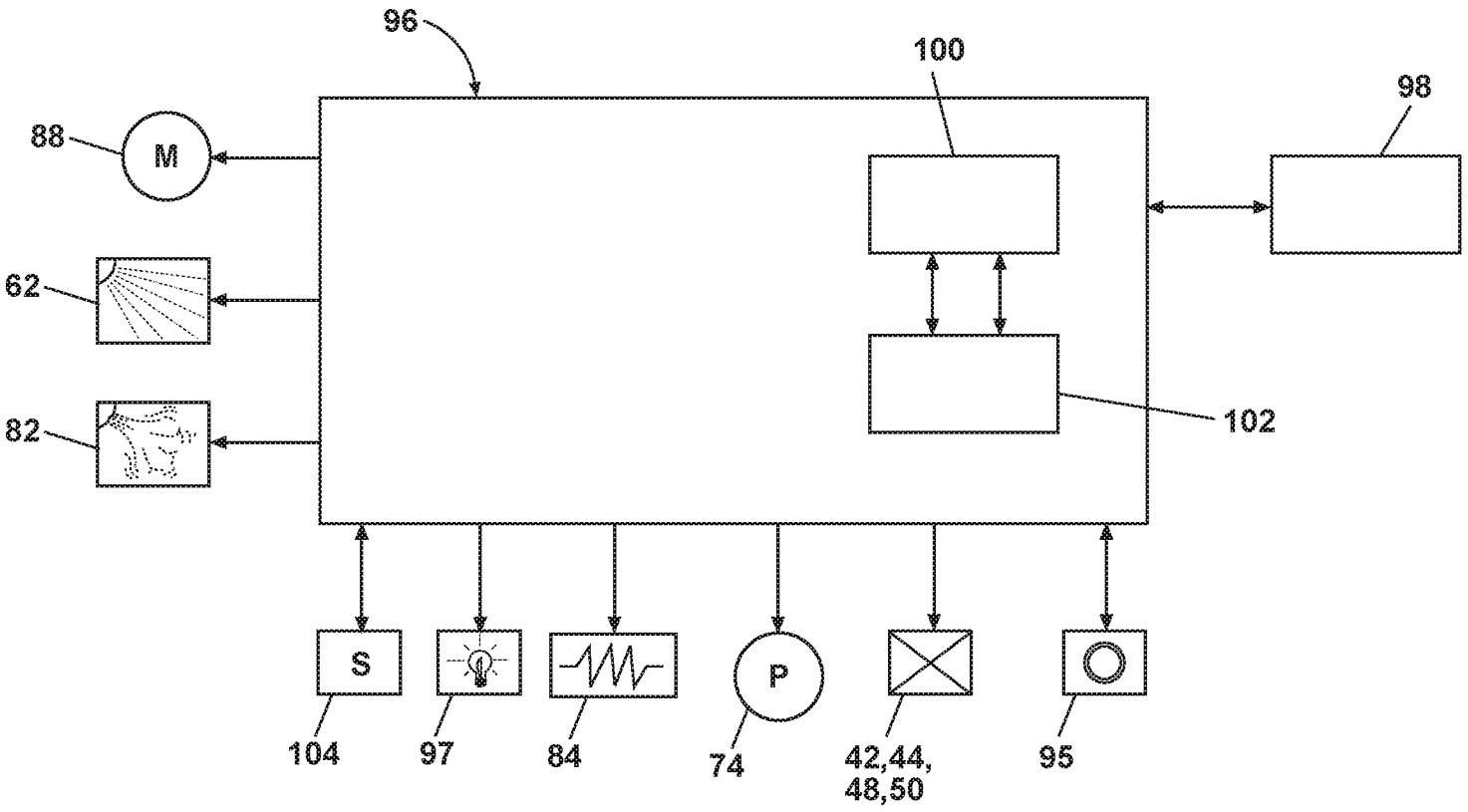
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that may be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, a load size sensor, and a motor torque sensor, which may be used to determine a variety of system and laundry characteristics, such as laundry load inertia or mass.

The controller 96 may also be coupled with the imaging device 95 to capture one or more images of the treating chamber 18. The controller 96 may operate the illumination source 97 at the same although this need not be the case as the imaging device 95 may capture images without the use of the illumination source 97. The captured images may be sent to the controller 96 and analyzed using analysis software stored in the memory 100 of the controller 96 to detect at least one graduated marking 21 in the generated image. The controller 96 may use the detection of the at least one graduated marking to determine a load size of the laundry within the treating chamber 18.

Figure 3A:
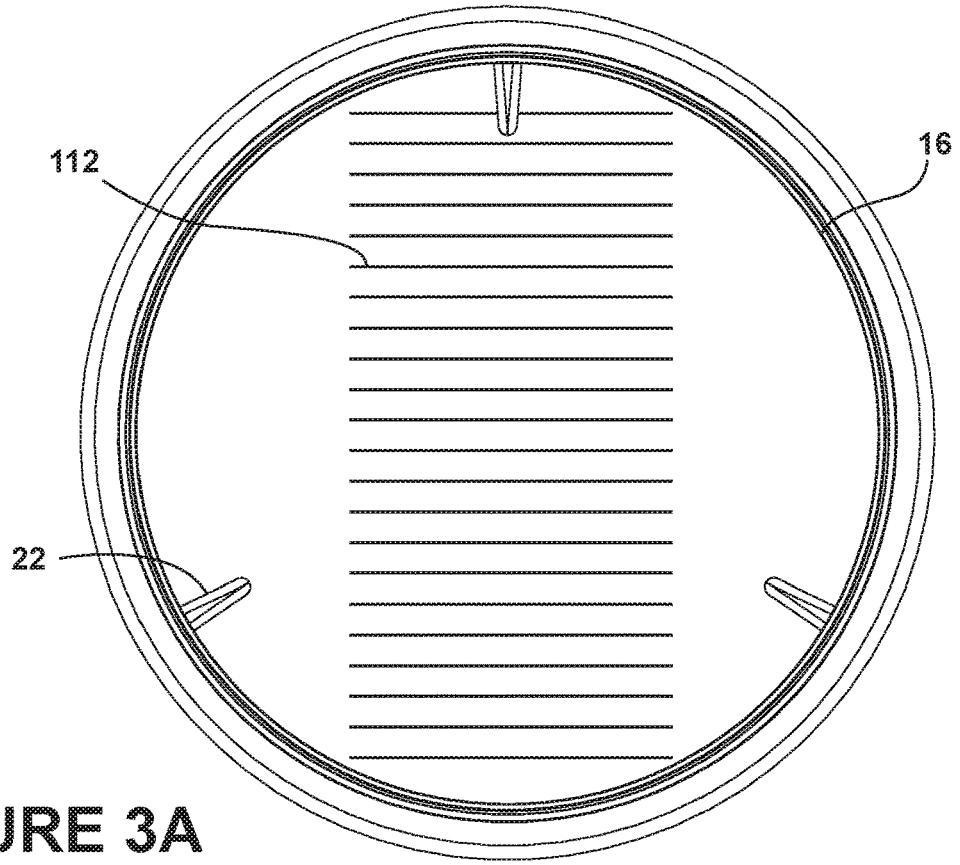
FIGS. 3A-3B schematically illustrate examples of graduated markings on a rear bulkhead of the laundry treating appliance of FIG. 1.
Figure 3B:
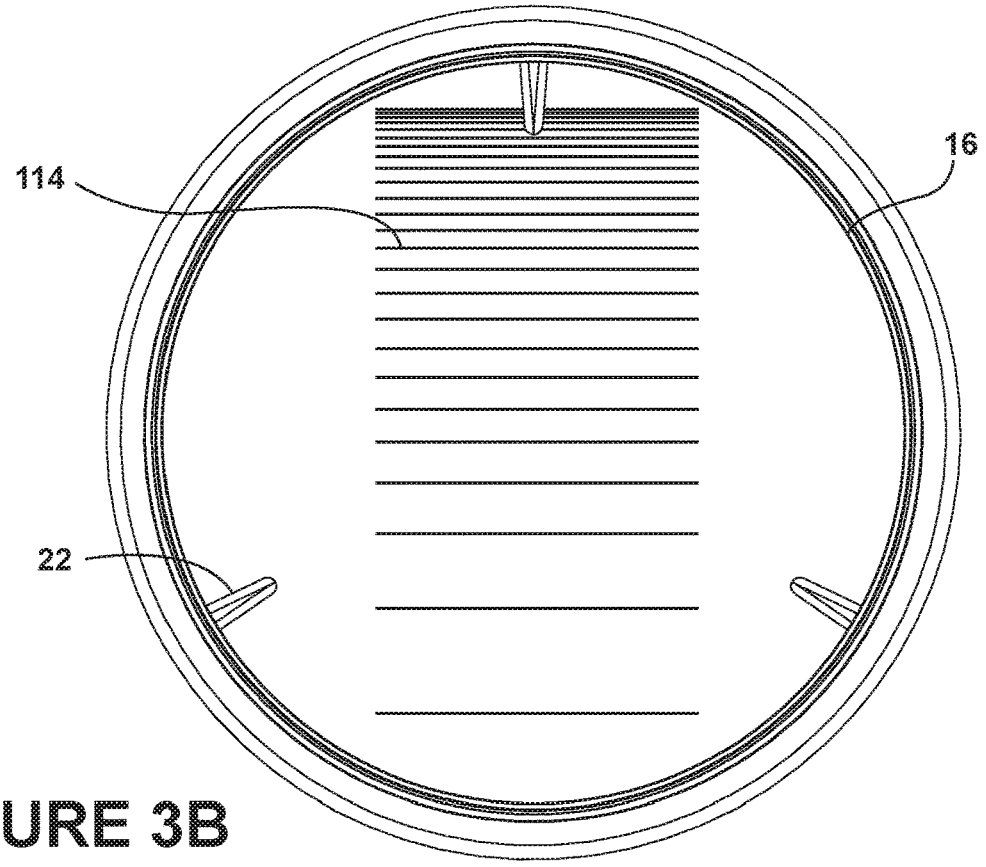

FIG. 3A illustrates alternative graduated markings 112 that may be included in the treating chamber 18 of the washing machine 10. More specifically the graduated markings 112 have been illustrated on a rear bulkhead of the drum 16. The graduated markings 112 are linear and are uniformly spaced. Conversely, another set of alternative graduated markings 114 are shown in FIG. 3B, which are similar to those of FIG. 3A except they are non-uniformly spaced with larger spacing towards the bottom of the drum 16 and small spacing towards the top of the drum 16. In this manner, a portion of the multiple graduated markings 114 increase in number per unit height of the drum 16 as the multiple graduated markings 114 go up in height. This allows for more accurate size determination when laundry begins to fill the upper portions of the drum 16.

Figure 4:
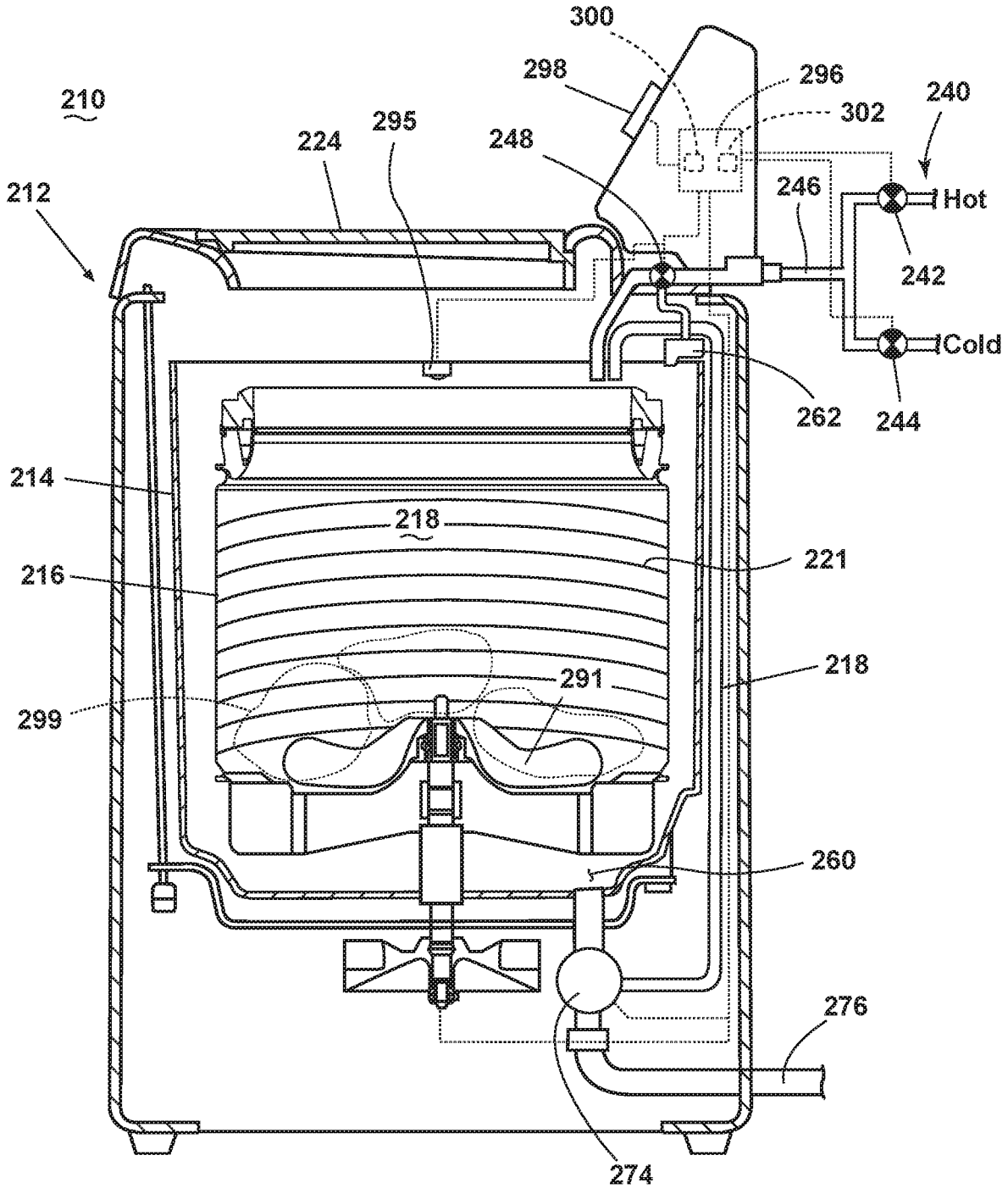
FIG. 4 is a schematic view of a laundry treating appliance in the form of an alternative washing machine.

FIG. 4 illustrates an alternative laundry treating appliance in the form of a vertical-axis washing machine 210. The vertical axis washing machine 210 is similar to the horizontal-axis washing machine 10 illustrated in FIG. 1. Therefore, like parts will be identified with like numerals increased by 200, with it being understood that the description of the like parts of the horizontal-axis washing machine applies to the vertical-axis washing machine embodiment, unless otherwise noted.

Unlike the earlier described washing machine 10, the washing machine 210 includes a perforated, open top drum 216 rotatably mounted inside the wash tub 214 and includes an agitator 291 or other type of clothes load and/or wash liquid mover rotatably mounted therein, as is well known in the washing machine art. Like the earlier described appliance, graduated markings 221, in this case curved graduated markings 221, are formed on the interior of the drum 216. While the graduated markings 221 are illustrated as rings that go up the side of the open top drum 216, the graduated markings 221 may be shaped and arranged in any suitable manner. It will be understood that the markings may be continuously or discontinuously formed around the open top drum 216 so that the open top drum 216 may be in any rotational position and the graduated markings 221 may still be imaged as needed. Further, an imaging device 295 may be included in the washing machine 210 and may be configured to image the treating chamber 218 and/or anything within the treating chamber 218. The imaging device 295 may be located in any suitable location so that it may image the treating chamber 218 including on the door 224, on a portion of the tub 214, or on a portion of the drum 216.

As with the earlier described embodiment, the controller 296 may also be coupled with the imaging device 295 to capture one or more images of the treating chamber 218, any laundry 299 therein, and at least one graduated marking 221. The captured images may be sent to the controller 296 and analyzed using analysis software stored in the controller memory 300 to detect at least one graduated marking 221 in the generated image. The controller 296 may use the detection of the at least one graduated marking to determine a load size of the laundry within the treating chamber 218.

Figure 5:
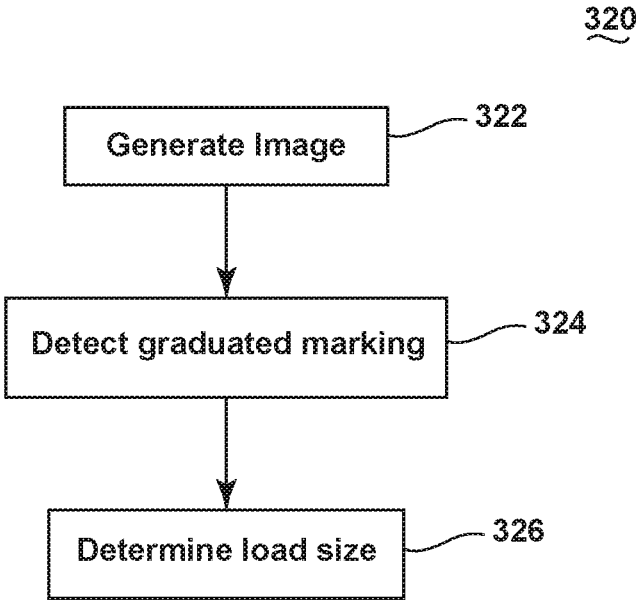
FIG. 5 is a flow chart illustrating a method of operating the washing machines of FIGS. 1 and 4.

Referring now to FIG. 5, a flow chart of a method 320 for determining a laundry load size in a laundry treating appliance, such as the washing machine 10 and the washing machine 210, is illustrated. While each of the washing machines may implement the method 320, for ease of explanation the method 320 will be explained with respect to the washing machine 10. The sequence of steps depicted for this method is for illustrative purposes only, and is not meant to limit the method in any way as it is understood that the steps may proceed in a different logical order or additional or intervening steps may be included without detracting from the invention. The method 320 may be implemented in any suitable manner, such as automatically or manually, as a stand-alone phase or cycle of operation or as a phase of an operation cycle of the washing machine 10. The method 320 may also be implemented while a user may be loading the washing machine 10 to aid in alerting the user as to the size of the laundry load in the washing machine 10. For example, the method 320 may start at step 322 while the user may be loading the washing machine 10 with one or more articles to form the laundry load, or when the laundry load may be loaded into the washing machine 10. The method 320 may be initiated automatically when the user opens or closes the door 24, or at the start of a user selected operating cycle.

At 322, the imaging device 95 may generate an image of a portion of the treating chamber 18 having the graduated markings 21. Generating the image may include generating an image of multiple graduated markings 21 that are uniformly spaced or non-uniformly spaced within the treating chamber 18. Generating the image may include generating an image of at least one graduated marking 21 formed at any location, such as on a rear bulkhead of the laundry treating appliance or on the drum 16. Generating the image may include generating an image of at least one graduated marking 21 formed by at least one perforation 20 in the drum 16 or of at least one graduated marking 21 having a reflectance or specific color. The reflectance or specific color may be selected because the treating chamber 18 may be a wet environment that may be highly reflective and the graduated markings 21 are meant to stand out in such an environment.

At 324, the controller 96 may detect at least one graduated marking 21 in the generated image. It is contemplated that laundry in the treating chamber 18 may cover a number of the graduated markings 21 and that a graduated marking 21 or a portion of the graduated marking 21 where laundry may not be blocking the graduated marking 21 may be detected in the image. The detecting may be done by having the generated image undergo image analysis. The generated image may be sent to the controller 96 for image analysis using software that may be stored in the memory 100 of the controller 96. The controller 96 may apply an algorithm to process the image. The algorithm may be implemented as a set of executable instructions that may be carried out by the CPU 102 in the controller 96. It may also be within the scope of the invention for the imaging device 95 to have a memory and a microprocessor for storing information and software and executing the software, respectively. In this manner, the imaging device 95 may analyze the captured image data and communicate the results of the analysis with the controller 96.

In one exemplary type of image analysis, at least one graduated marking 21 may be isolated from the background, i.e. the drum 16, of the captured image. Isolating the at least one graduated marking 21 from the background may include identifying the at least one graduated marking 21 within the image or extracting one or more portions of the at least one graduated marking 21 from the image. Regardless of how the at least one graduated marking 21 may be isolated from the background, the at least one graduated marking 21 may be used to determine a load size of the laundry load within the drum 16 at 326. More specifically, based on the presence or absence of a graduated marking 21 in the image the controller 96 may determine the size of the laundry load. For example, the determined at least one graduated marking 21 may be used to calculate the edge, volume, area, perimeter, radius and major or minor axis of the load using known methods. Further, the controller 96 may be able to determine the load size based on the number of identified graduated markings 21 or the location of the identified graduated markings 21. For example, it will be understood that the larger the laundry load the more graduated markings 21 that will be covered by the larger laundry load and that the controller 96 may determine that the laundry load may be large based on which graduated markings 21 may be detected or how many, or few, graduated markings 21 may be detected. For example, the image may be processed to count the number of graduated markings 21 visible in the image below the top graduated marking 21. In the case where the plurality of perforations 20 are used as graduated markings 21 the image may be processed to count the number of visible perforations 20. As the volume of the treating chamber 18 is known, the count represents the "free" volume of the treating chamber 18, which may be equated with the "filled" volume. The "filled" volume for a particular "free" volume or graduated markings 21 count may be stored in a table in the memory 100 of the controller 96. By way of further example, detecting four graduated markings 21 may indicate that the drum 16 may be only half full while detecting only one graduated marking 21 may indicate that the drum 16 may be almost completely full. Further, the number of graduated markings 21 may represent the height of the laundry load such that the height of the laundry load may be determined. From the height of the laundry load a volume of the laundry load may be estimated.

It will be understood that the method of determining the laundry load size may be flexible and that the method illustrated above is merely for illustrative purposes. For example, regardless of which laundry treating appliance may be utilized, the controller may use the determined load size to set one or more operating parameters of the treating cycle of operation to control the operation of at least one component with which the controller may be operably coupled with to complete a cycle of operation. For example, the parameter that may be set may include a cycle time, an air flow rate in the treating chamber, a wash liquid fill level, a tumble pattern, an amount of treating chemistry, a type of treating chemistry, etc. The controller may also indicate a variety of information through the user interface based on the determined load size including the set cycle time and the determined load size. Furthermore, a type of laundry within the laundry load may be determined from the images. More specifically, different types of laundry items are known to lie differently and the laundry type may be determined based on such knowledge. For example, mountains and valleys in the laundry load may be determined in the generated image and the type of the load may be determined based on the mountains and valleys. Delicate fabric would lie more flat whereas a jeans load would have more mountains and valleys because they are of stiffer construction. Such information may also be utilized in setting a parameter of the cycle of operation. Further still information regarding the load may be transferred to a dryer or other laundry treating appliance where the laundry load may be intended to be subsequently transferred to.

The above described embodiments provided a variety of benefits including that the size of the load may more accurately be determined. Currently laundry treating appliances only measure a mass of the laundry load while users loads according to volume or how full they perceive the laundry treating appliance to be. Applying a strict mass sensor may be problematic for capacity detection because if a comforter which weighs about four pounds but is very voluminous is placed inside a washing machine the mass sensor would indicate that it is only a quarter full by mass but by volume it is taking up the entire space inside the drum. The customer may then get confused by the mass sensor and think that it is acceptable to put more fabric inside, which could reduce cleaning performance, cause the motor to overheat, etc. The above embodiments allow for a size determination of the laundry load that provides a good user experience. Further the above embodiments may be used to determine load type and may allow cycle parameters to be more accurately determined, which may result in energy, water consumption, and time savings as well as allowing the laundry treating appliance to be operated in an effective and efficient manner To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Further, it will be understood that any suitable image generation techniques may be used including that generating the image may include generating at least one of a still image or a video and may include capturing a digital image. Further, the image may be a visible light image, an ultraviolet light image, an infrared image, etc.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of determining a laundry load size in a laundry treating appliance comprising a treating chamber for receiving a laundry load for treatment in accordance with a treating cycle of operation, an imaging device, and a controller having a processor, the method comprising:

generating an image, with the imaging device, of at least a portion of the treating chamber where the treating chamber has detectable graduated markings located on a solid portion forming the treating chamber;

detecting, by the controller, at least one of the detectable graduated markings in the generated image; and determining, by the controller, a load size based on the detected at least one of the detectable graduated markings wherein the determining the load size comprises comparing the detected at least one of the detectable graduated markings to reference information that indicates a free volume or free height associated with the detected at least one of the detectable graduated markings.

2. The method of claim 1 wherein generating the image comprises generating an image of at least one detectable graduated markings formed on at least one of a door or window.

3. The method of claim 1 wherein generating the image comprises generating an image of at least one detectable graduated markings having a reflectance or specific color.

4. The method of claim 1 wherein the determining the load size comprises determining a height of the laundry load based on the detected at least one of the detectable graduated markings.

5. The method of claim 4 wherein the determining the load size further comprises estimating a volume of the laundry load based on the determined height.

6. The method of claim 1 wherein the generating the image comprises generating at least one of a still image or a video.

7. The method of claim 1 wherein the generating the image comprises taking a visible light image, an ultraviolet light image, or an infrared image.

8. The method of claim 1, further comprising setting at least one parameter of the treating cycle of operation based on the determined load size.

9. The method of claim 8 wherein the at least one parameter is a cycle time, an air flow rate in the treating chamber, a wash liquid fill level, or an amount of treating chemistry.

10. The method of claim 9, further comprising indicating the cycle time on a user interface of the laundry treating appliance.

11. The method of claim 1 wherein the detectable graduated markings include an uppermost graduated marking and graduated markings there below and determining the load size comprises determining a number of graduated markings visible in the image below the uppermost graduated marking.

12. A method of determining a laundry load size in a laundry treating appliance comprising a generally cylindrical drum or a generally cylindrical tub defining a treating chamber configured for receiving laundry for treatment in accordance with a treating cycle of operation, an imaging device, and a controller having a processor, the method comprising:

generating an image, with the imaging device, of at least a portion of the generally cylindrical drum or the generally cylindrical tub where detectable graduated markings are located on the at least a portion of the generally cylindrical drum or the generally cylindrical tub;

detecting, by the controller, at least one of the detectable graduated markings in the generated image; and determining, by the controller, a load size based on the detected at least one of the detectable graduated marking wherein the determining the load size comprises comparing the detected at least one of the detectable graduated markings to reference information that indicates a free volume or free height associated with the detected at least one of the detectable graduated markings located on at least a portion of the generally cylindrical drum or the generally cylindrical tub.

13. The method of claim 12, further comprising setting at least one parameter of the treating cycle of operation based on the determined load size.

14. The method of claim 13 wherein the at least one parameter is a cycle time, an air flow rate in the treating chamber, a wash liquid fill level, or an amount of treating chemistry.

15. The method of claim 14, further comprising indicating the cycle time on a user interface of the laundry treating appliance.

16. The method of claim 12 wherein the detectable graduated markings include an uppermost graduated marking and graduated markings there below and determining the load size comprises determining a number of graduated markings visible in the image below the uppermost graduated marking.

17. The method of claim 12 wherein the detectable graduated markings are non-uniformly spaced.

18. A method of determining a laundry load size in a laundry treating appliance comprising an imaging device and a controller having a processor, the method comprising:

generating an image, with the imaging device, of at least a portion of a treating chamber defined by a perforated receptacle configured for receiving laundry for treatment in accordance with a treating cycle of operation wherein perforations of the perforated receptacle define detectable graduated markings located on at least a portion of the laundry treating chamber;

detecting, by the controller, at least one of the detectable graduated markings in the generated image by processing the image with computer software stored in the controller; and determining, by the controller, a load size based on the detected at least one of the detectable graduated markings in comparison to reference information that indicates a free volume or free height associated with the detected at least one of the detectable graduated markings located on at least a portion of the laundry treating chamber.

19. The method of claim 18, further comprising setting at least one of a cycle time, an air flow rate in the treating chamber, a wash liquid fill level, or an amount of treating chemistry based on the load size.

20. The method of claim 18 wherein the detectable graduated markings are non-uniformly spaced.

* * * * *